US005301830A

United States Patent [19]

Müller

[11] Patent Number: 5,301,830

[45] Date of Patent: Apr. 12, 1994

[54] CONTAINER

[76] Inventor: Michael R. Müller, C/.Bonavista, 7 - 2º/2ª, 08012-Barcelona, Spain

[21] Appl. No.: 862,898

[22] Filed: Apr. 3, 1992

[30] Foreign Application Priority Data

Apr. 5, 1991 [ES] Spain ..... 9101012

[51] Int. Cl.[5] ..... A47G 19/22; B65D 1/40

[52] U.S. Cl. ..... 220/669; 220/703; 220/906; 220/914

[58] Field of Search ..... 220/669, 716, 906, 914, 220/670, 672, 703, 704, 718, DIG. 5

[56] References Cited

U.S. PATENT DOCUMENTS

| | | | |
|---|---|---|---|
| 1,832,806 | 11/1931 | Dawson | 220/703 X |
| 2,627,735 | 2/1953 | Dexter | 220/703 |
| 3,297,194 | 1/1967 | Schaper et al. | 220/672 |
| 3,704,805 | 12/1972 | Sheafe, III | 220/716 X |
| 3,891,116 | 6/1975 | Schane | 220/270 |
| 4,044,916 | 8/1977 | Beveridge | 220/270 |
| 4,316,551 | 2/1982 | Belokin, Jr. | 220/906 X |
| 4,752,016 | 6/1988 | Eads | 220/253 |
| 4,852,763 | 8/1989 | Dimberio | 220/253 |
| 4,880,136 | 11/1989 | Englert | 220/253 |
| 4,883,192 | 11/1989 | Krugman | 220/711 |
| 4,925,050 | 5/1990 | Yu | 220/906 X |
| 5,108,003 | 4/1992 | Granofsky | 220/257 |
| 5,117,980 | 6/1992 | Ionides | 220/717 X |

*Primary Examiner*—Stephen P. Garbe
*Assistant Examiner*—Vanessa Caretto
*Attorney, Agent, or Firm*—Robert W. Becker & Associates

[57] ABSTRACT

A container in the form of a beverage-containing can. The can has a top, bottom, and side portion interconnecting the top and bottom. The top of the can is provided with a pull-out section to provide to a consumer access to the can contents. The side portion is provided with a groove disposed adjacent to the top. This groove has a shape that is essentially adapted to the lower lip anatomy of a consumer.

2 Claims, 2 Drawing Sheets

CONTAINER

BACKGROUND OF THE INVENTION

The present invention relates to a container.

Of particular relevance is a type of container that is in the form of a can for cold drinks or similar beverages.

Heretofore known containers in the form of cans for cold drinks have the drawback that when the consumer drinks directly from the container, part of the liquid spills at the moment of drinking due to a small, i.e. poor, anatomical configuration of the can which is very annoying and reduces the use and convenience of canned drinks.

It is therefore an object of the present invention to avoid the drawbacks of the heretofore known containers, and to provide a novel configuration for a container, especially a container for beverages, that has remarkable advantages over those that are already available on the market.

BRIEF DESCRIPTION OF THE DRAWING

This object, and other objects and advantages of the present invention, will appear more clearly from the following specification in conjunction with the accompanying schematic drawing, in which.

SUMMARY OF THE INVENTION

Figure 2:
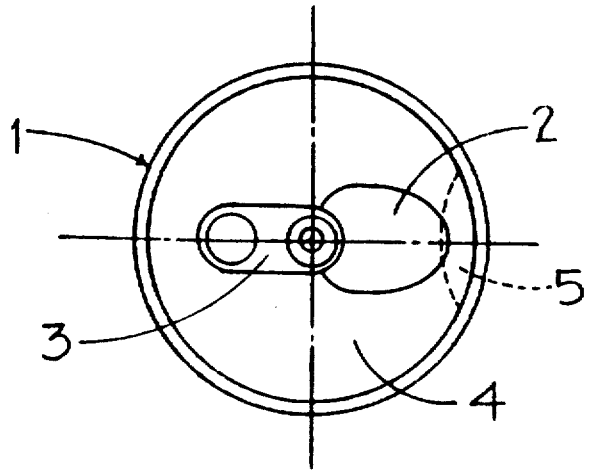
FIG. 2 is a side view of the container of FIG. 1.
Figure 1:
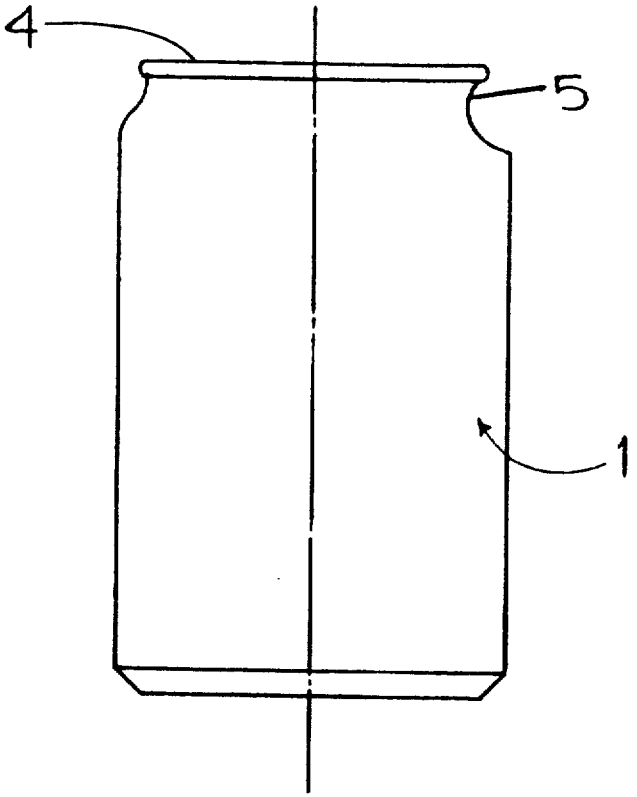
FIG. 1 is a top view of one exemplary embodiment of the container of the present invention.
Figure 3:
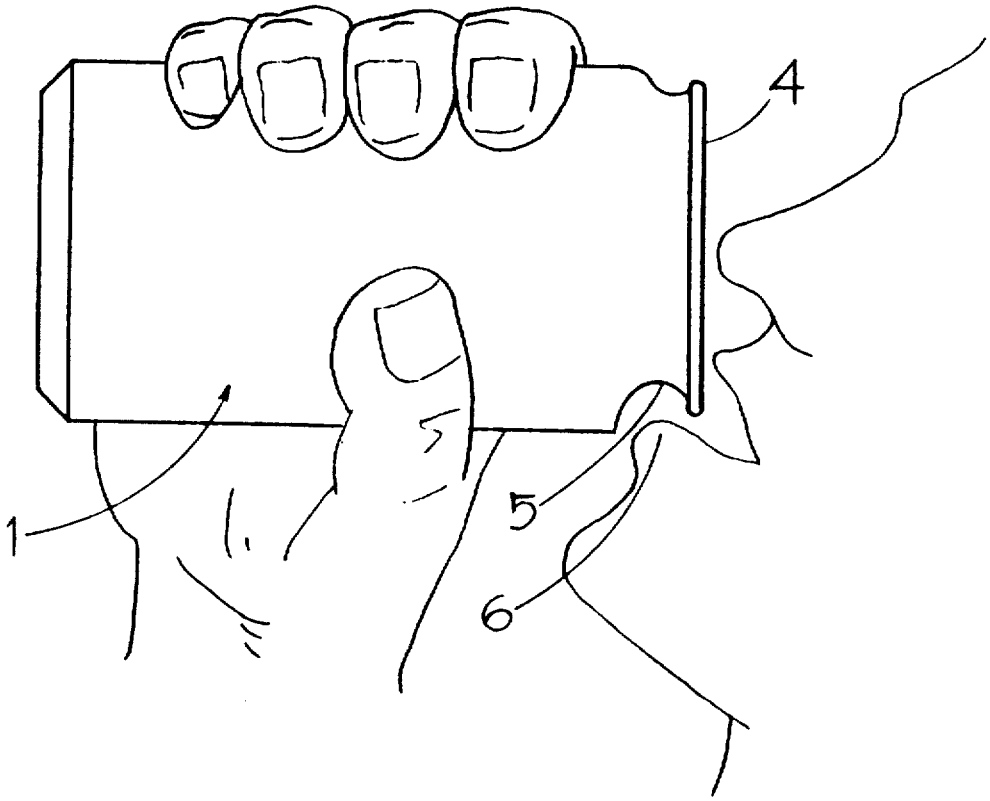
FIG. 3 shows a practical application of the inventively configured container.

The present invention provides for a container that is i n the form of a beverage-containing can and has a top, bottom, and side portion interconnecting the top and bottom, with the top being provided with opening means for providing a consumer access to the can contents, with the side portion being provided with a groove disposed adjacent to the top, and with this groove having a shape that is essentially adapted to the lower lip anatomy of the consumer.

As a result of this novel configuration for a beverage-containing can, a consumer can drink directly from the can with a maximum of comfort and without any chance of spilling any of the liquid, in distinct contrast to the situation encountered with beverage cans that are presently on the market.

Although the groove could extend all the way around the can, just below the top of the can, in one preferred embodiment of the present invention the groove is disposed at only one location in the side portion of the can. In particular, the groove is disposed only in the immediate vicinity, i.e., right in front of, the pour-out hole that is provided in the top of the can.

Pursuant to one specific embodiment of the present invention, the groove has an ellipsoidal configuration.

DESCRIPTION OF PREFERRED EMBODIMENTS

Referring now to the drawing in detail, shown is an improved container in the form of a can 1 that is designed to contain a beverage such as a cold drink. The can 1 is provided with a pull-out section 2 that can be removed by a holed pull tab 3 on the top 4 of the can to enable the consumer to easily open the can and to drink directly from it.

The proposed container introduces the novelty of having on the lateral side and right next to the top face 4 an ellipsoidal rabbet, hollow or groove 5 that is compatible with the lower lip anatomy 6 of consumers, giving them the guarantee of maximum comfort during the action of drinking and avoiding any possibility of spilling the liquid during this action.

Although the invention has been described in conjunction with a beverage container, it can be manufactured in any shape and size from appropriate materials in conformity with the intended application.

The present invention is, of course, in no way restricted to the specific disclosure of the specification and drawings, but also encompasses any modifications within the scope of the appended claims.

What I claim is:

1. In a container that is in the form of a beverage-containing can and has a top, bottom, and side portion interconnecting said top and bottom, with said top being provided with opening means for providing to a consumer access to contents of said can, the improvement wherein:

said side portion is provided with a circumferential groove having a first radial depth and a second radial depth extending further radially inwardly than said first radial depth, said groove being disposed adjacent to said can, with said second radial depth having a shape that is essentially adapted to a lower lip anatomy of a consumer;

said opening means includes a pull tab for removing a pull-out section to form a pour-out hole; and said second radial depth being disposed only in the immediate vicinity of said pour-out hole.

2. A container according to claim 1, in which said second radial depth having an ellipsoidal configuration.

* * * * *